US005620341A

United States Patent [19]

Peng et al.

[11] Patent Number: 5,620,341

[45] Date of Patent: Apr. 15, 1997

[54] ESD AND EMI PROTECTED ETHERNET LAN TAP

[75] Inventors: Ping Peng, Harrisburg; Paul J. Anastasio, Camp Hill; Nilesh B. Pathak, Harrisburg, all of Pa.

[73] Assignee: The Whitaker Corporation, Wilmington, Del.

[21] Appl. No.: 415,891

[22] Filed: Apr. 3, 1995

[51] Int. Cl.[6] ..... H01R 13/66

[52] U.S. Cl. ..... 439/620; 439/188

[58] Field of Search ..... 439/620, 188, 439/944, 79, 578, 581, 583, 638, 641, 417, 492, 76

[56] References Cited

U.S. PATENT DOCUMENTS

| | | | |
|---|---|---|---|
| 4,481,641 | 11/1984 | Gable et al. | 439/492 |
| 4,772,221 | 9/1988 | Kozlof | 439/549 |
| 4,797,120 | 1/1989 | Ulery | 439/578 |
| 4,827,378 | 5/1989 | Gillan et al. | 361/424 |
| 4,934,960 | 6/1990 | Capp et al. | 439/620 |
| 5,062,811 | 11/1991 | Hackman | 439/620 |
| 5,073,123 | 12/1991 | Birch et al. | 439/188 |
| 5,108,300 | 4/1992 | Weber | 439/620 |
| 5,145,412 | 9/1992 | Tan et al. | 439/620 |
| 5,167,536 | 12/1992 | Wang | 439/620 |
| 5,215,478 | 6/1993 | Briones | 439/620 |
| 5,221,216 | 6/1993 | Gabany et al. | 439/620 |
| 5,342,203 | 8/1994 | Perretta et al. | 439/76 |
| 5,387,116 | 2/1995 | Wang | 439/188 |

*Primary Examiner*—Khiem Nguyen
*Assistant Examiner*—Yong Kim

[57] ABSTRACT

A tap connector (12) for a coaxial cable to provide signal and signal ground connection to a transceiver. The connector (12) includes a shunt subassembly (54) which provides a low impedance pathway for EMI and ESD from the signal ground to earth ground on the transceiver. The shunt subassembly includes a grounding strap (56) connected to a the signal ground, a chip capacitor (68), a circuit board (62), and a screw (78) to connect to earth ground on the transceiver (14).

8 Claims, 4 Drawing Sheets

ESD AND EMI PROTECTED ETHERNET LAN TAP

FIELD OF THE INVENTION

The invention relates to a capacitive ground coupling for an Ethernet tap connector.

BACKGROUND OF THE INVENTION

Local area network (LAN) is a collection of hardware and software that connects individual PCs and workstations together for resourcing, sharing, messaging services and work group computing. A type of basic LAN interfaced design is the Ethernet. The Ethernet typically uses a base band or a broad band transmission. The base band transmission carries a single digital signal at data rates as high as 100 megabytes per second. Data is placed directly on the media without modulation and only one signal is allowed on the cable at a time. Broad band transmission carries multiple data channels. It requires a large band width or operating frequency range in order to allow many carrier frequencies on one cable.

One type of Ethernet is the Thicknet Ethernet or 10BASE5. This version is a coaxial cable which carries baseband signaling. The cable is grounded only once every 500 meters to prevent ground loops. A tap is connected to the Ethernet thick coaxial cable to provide electrical connection to a transceiver which in turn provides signal to a network device. A typical tap connector provides both signal and signal ground connections to the transceiver, however, the signal ground is not grounded to earth ground.

Because there is such a large distance between grounding points, electrostatic discharge (ESD) and common electromagnetic interference (EMI) are two potential problems which can exist between the grounding points. It is necessary to protect taps which are remote from the grounding point from the ESD and common mode EMI.

U.S. Pat. No. 5,221,216 shows a typical connector for a coaxial connector which is capacitively coupled to ground. The signal ground of the coaxial connector is connected to a shell on the conductor. A around contact having resilient arms is secured to the ground on the circuit board. The resilient arms are used to secure a chip capacitor between the ground shell and the ground contact thereby forming a shunt pathway for EMI and ESD which is on the signal ground of the coaxial connector. without actually forming an electrical connection between the signal ground and the earth ground.

It would be desirable to provide a tap connector in which the signal ground is capacitively coupled to earth ground.

SUMMARY OF THE INVENTION

A tap connector of the present invention comprises a connecting member having a center conductor, a conductive outer shell, a signal tap contact, and a ground tap contact. The center conductor is electrically connected to the signal of the coaxial cable and to the signal tap contact to provide the signal to a transceiver. The outer shell is electrically connected to the signal ground of the coaxial cable and to the ground tap contact to provide signal ground to the transceiver. The connector further includes a shunt subassembly having a capacitor to shunt EMI and ESD from the signal ground on the coaxial cable to the earth ground on the transceiver.

BRIEF DESCRIPTION OF THE DRAWINGS

An embodiment of the present invention will now be described by way of example with reference to the accompanying drawings, in which.

DETAILED DESCRIPTION OF THE INVENTION

Figure 1:
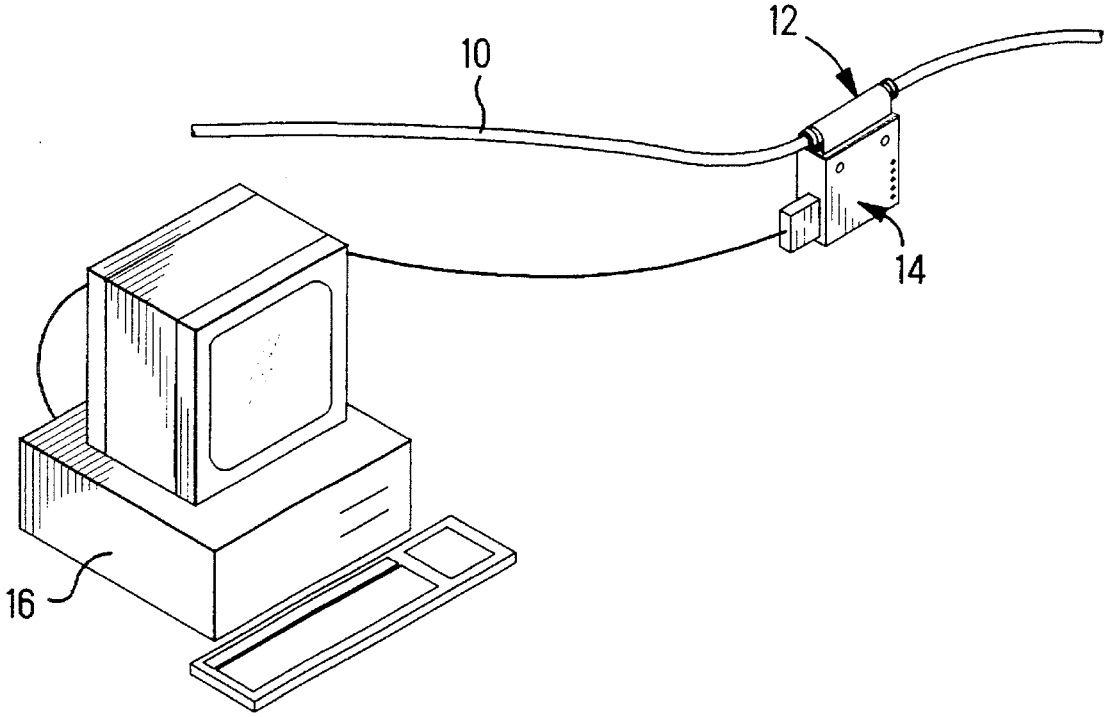
FIG. 1 is a perspective view showing an Ethernet, a tap connector, a transceiver, and a network device.
Figure 2:
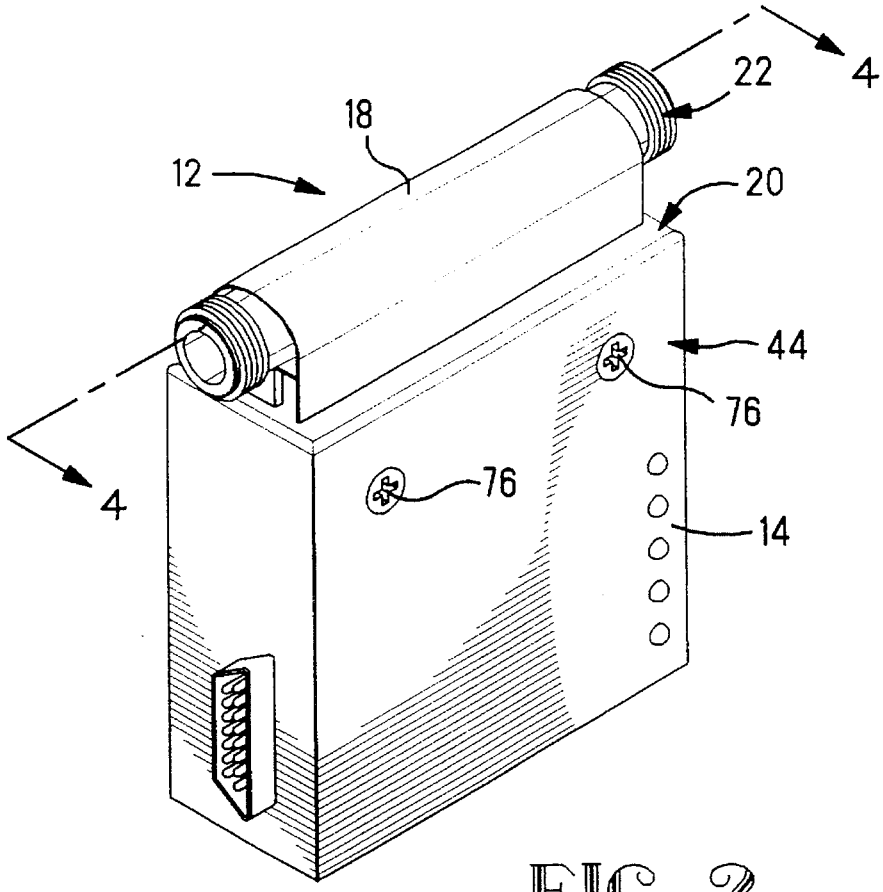
FIG. 2 is a perspective view showing the transceiver and the tap connector.

FIG. 1 shows an Ethernet Thicknet coaxial cable backbone 10. The coaxial cable 10 comprises a center signal conductor which provides the signal pathway and is surrounded by an insulating layer. A grounding conductor is disposed around the insulating layer to protect the signal from EMI and to provide a pathway for the signal ground as is well known in the art.

A tap connector 12 is connected along the Ethernet by connecting ends of the coaxial cable 10 to the tap connector 12. The tap connector 12 in turn is connected to a transceiver 14. The tap connector 12 provides both the signal and signal ground connection to the transceiver 14. The transceiver then provides the signal to a network device 16 such as a computer or a printer. The transceiver also has an electrical connection to earth ground via the chassis of the transceiver in a manner that is well known in the art. The signal ground of the coaxial cable 10 and of the tap connector 12 remain isolated from the chassis ground of the transceiver 14.

Figure 3:
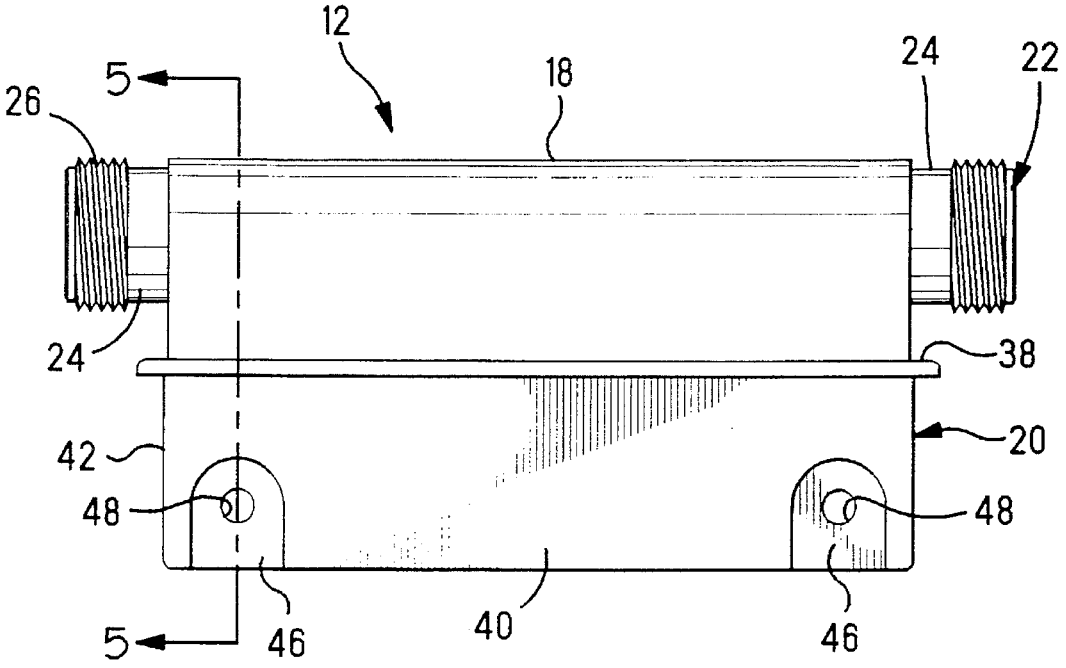
FIG. 3 is a side view showing the tap connector.
Figure 4:
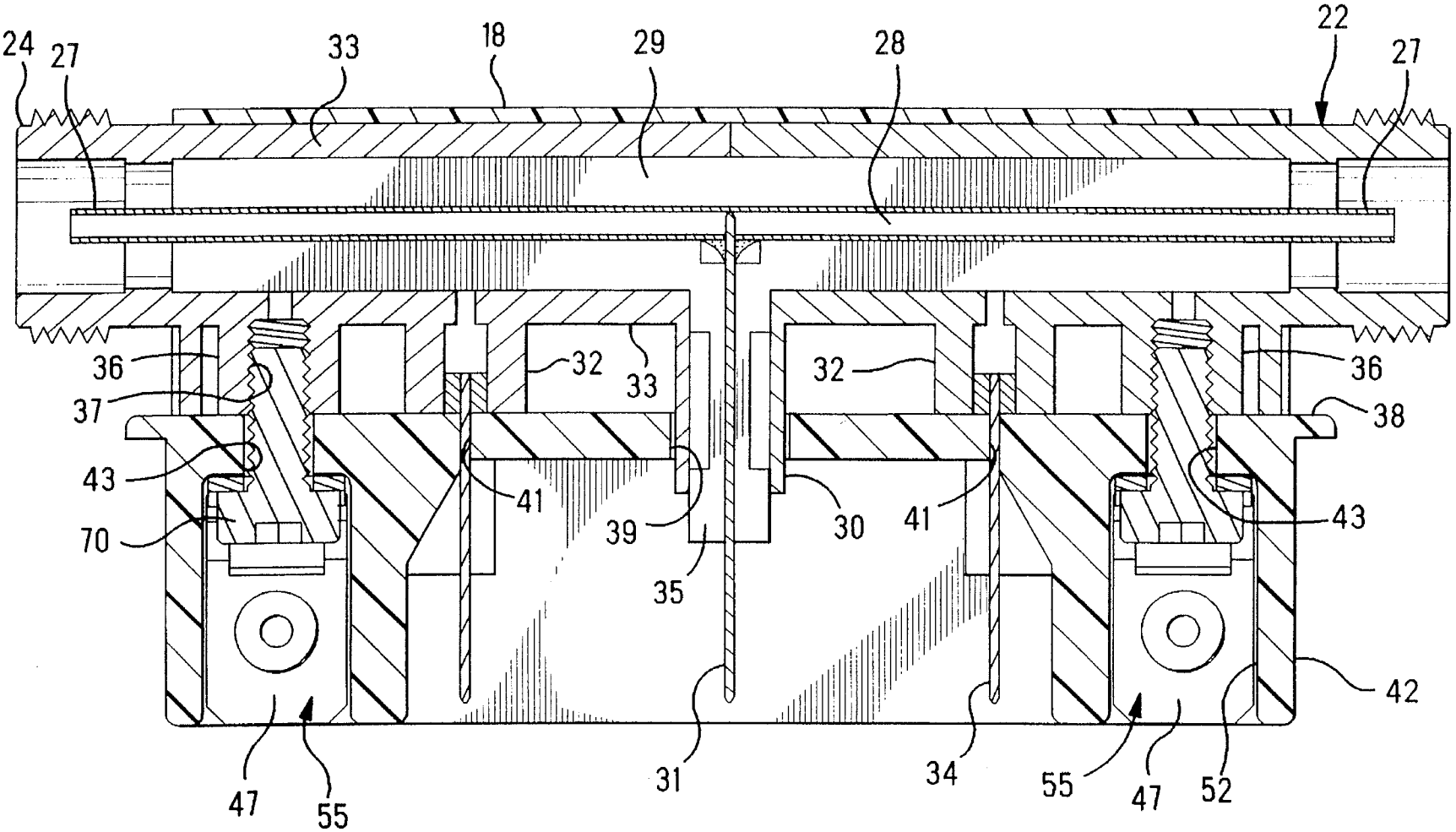
FIG. 4 is a cross sectional view of the tap connector without the transceiver, shown along the line 4—4 of FIG. 2.

FIGS. 3 and 4 show the tap connector 12 of the present invention in greater detail. The tap connector 12 comprises an insulating housing 20, an insulating cover 18, and a coaxial connecting portion 22. The connecting portion 22 has two ends 24 which provide connection to the coaxial cable 10. The ends 24 have threaded portions 26 which are used to secure the coaxial cable 10 thereto in a manner which is well known in the art. A signal conductor 28 is disposed along the center of the coaxial connecting portion 22 and has two ends 27 which are used to electrically connect the signal conductor 28 to the signal conductor of the coaxial cable 10. The signal conductor 28 provides both a through connection for the Ethernet signal and a tap connection to the transceiver 14. The signal conductor 28 is surrounded by an insulating layer 29. The outer portion of the coaxial connecting portion 22 is a conducting shell 33 which is electrically connected to the signal ground conductor on the coaxial cable 10.

The coaxial connecting portion 22 has five standoff legs, a center leg 30, two outer legs 36, and two intermediated legs 32, which extend downwardly from the connecting portion 22. The center leg 30 includes a tap signal conductor 31 which extends through an insulating layer 35. The tap signal conductor 31 is electrically connected to the signal conductor 28 and provides the signal to the transceiver when the tap is connected to the transceiver 14. The outer metal shell 33 extends down to surround the insulating layer 35.

The outer shell 33 also extends downwardly to form the two legs 32. The legs 32 are electrically connected to ground pins 34 which extend downwardly therefrom. The ground pins 34 provide the signal ground connection to the transceiver 14.

The outer legs 36 are also part of the outer metal shell 33 and provide electrical connection between the grounding outer metal shell 33 and the shunt subassembly which will be described later on. The outer legs 36 have screw holes 37 in which a screw can be secured and electrically connected to the signal ground by way of the outer metal shell 33.

The housing 20 has a top 38 with holes 39,41 extending therethrough in which the center leg 30 and the ground pins 34 extend, see FIG. 4. The top 38 further has two screw receiving holes 43 which are in alignment with the outer legs 36 when the coaxial connecting portion 22 is mounted thereon. The housing 20 is in the form of an open bottom box. The housing 20 has four walls 40,42 which extend downwardly from the top 38 to form an enclosure, see FIG. 3. The walls 40,42 are received within walls 44 on the top of the transceiver 14, see FIG. 5. The long walls 40 have recesses 46 with screw holes 48 therein. The housing 20 has two end chambers 47 which have inner walls 50,52 and top wall 54 which is along the top portion of the box, see FIG. 5.

Figure 5:
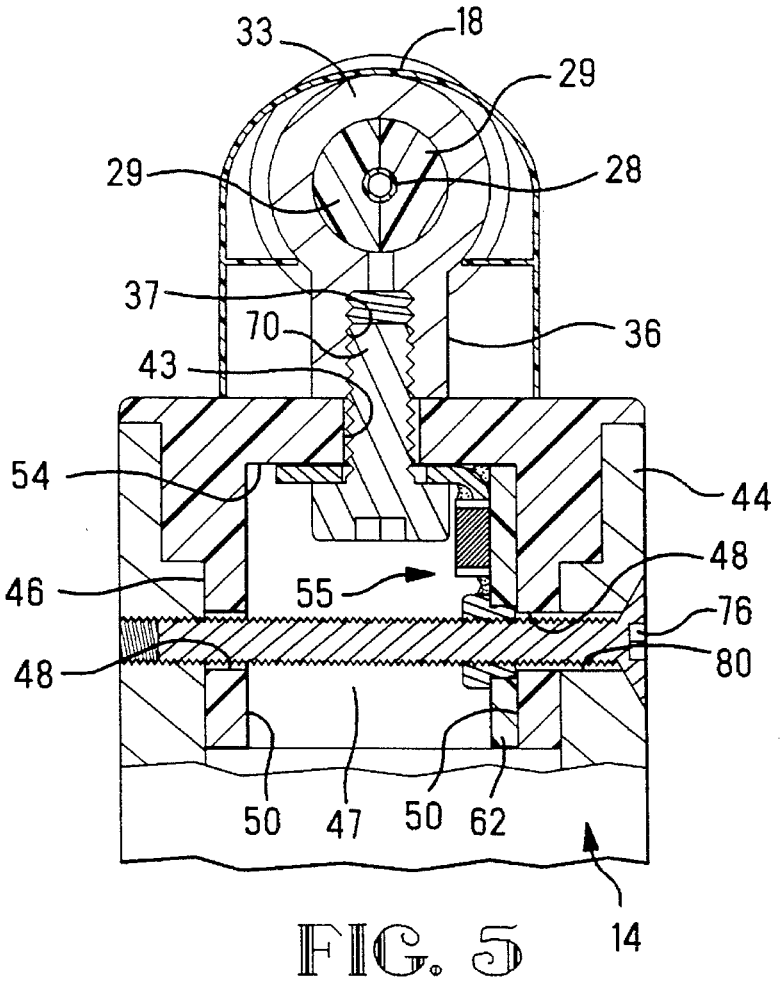
FIG. 5 is a cross sectional view showing the tap connector mounted to the transceiver, the tap connector being shown along the line 5—5 of FIG. 3.
Figure 6:
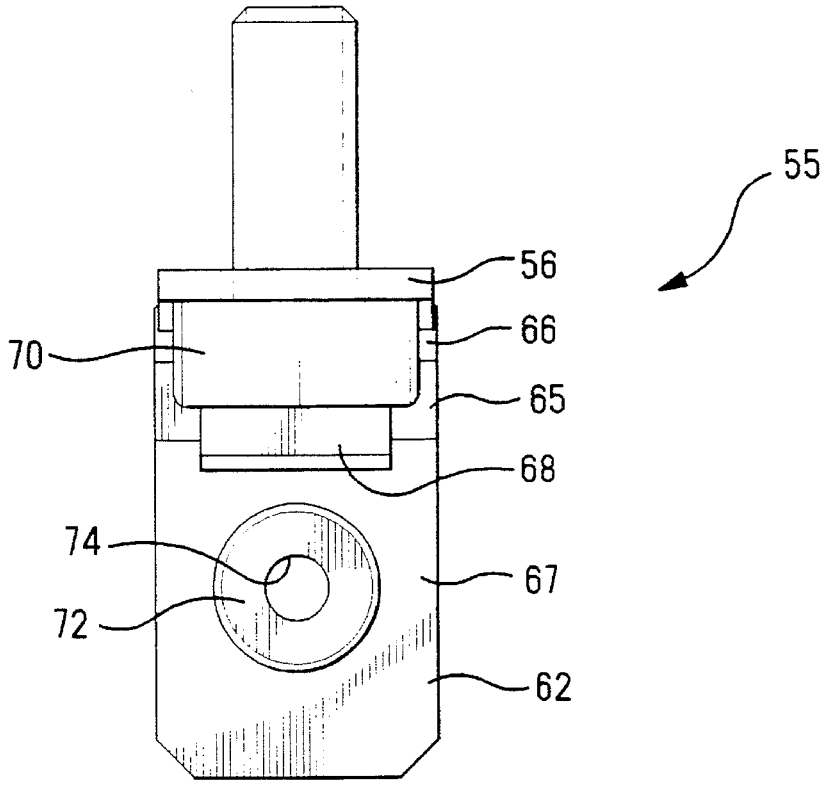
FIGS. 6 and 7 are side views of the shunt subassembly.
Figure 7:
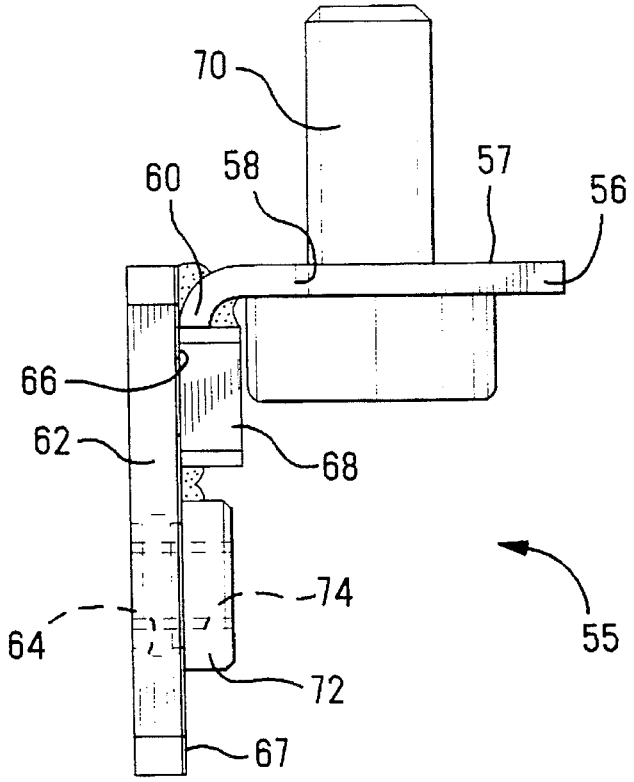

The shunt subassembly 54 is shown in FIGS. 4 and 5 and is shown in more detail in FIGS. 6 and 7. The subassembly is secured in the end chambers 47 and comprises a ground strap 56, a printed circuit board 62, and a chip capacitor 68. FIG. 4 shows the tap connector 12 having two subassemblies 54 positioned in each of the end chambers 47. Alternatively, the tap connector could have only one subassembly 54 present in one of the end chambers 47. The ground strap 56 includes a long flat portion 57 and a curved end 60. The long flat portion 57 includes a screw hole 58. When fully assembled, the grounding strap 56 is received along the top wall 54 with the screw hole 58 aligned with the screw hole 43 on the top wall, see FIG. 5.

The printed circuit board includes a hole 64. The printed circuit board further includes two conductive planes 66 and 67 with a space 65 separating the conductive planes 66,67. The conductive planes 66,67 are shown exaggerated in FIG. 7 in order to illustrate the position of the conductive planes 66,67 on the circuit board 62. One conductive plane 67 is in connection with the hole 64. The other conductive plane 66 is disposed along one end of the printed circuit board. The printed circuit board is flat and is received along the inner wall 50. The hole 64 receives a non-removable, press-fit fastener with internal thread (a PEM nut) 72. The PEM nut 72 is received within the hole 64 in an interference fit with the hole and has a screw hole 74 in the center of the PEM nut 72 to receive a screw. The PEM nut 72 provides a means of securing a screw within the hole and to provide both mechanical and electrical connection with the conducting plane 67. When assembled, the hole 64 is aligned with the screw hole 48 of the inner wall 50 and ground plane 66 is oriented towards the top wall 54. A chip capacitor 68, which has two conductive ends, is placed on top of the printed circuit board 62 such that one end of the capacitor is in connection with one conductive plane 67, and the other end is connection with the other conductive plane 66. The curved end 60 of the grounding strap 56 is received along side of the chip capacitor 68. The chip capacitor 68 is soldered to the curved end 60 of the grounding strap 56 and to the one conductive plane 66 on the printed circuit board, see FIG. 7. The other end of the chip capacitor 68 is soldered to the other conductive plane 67 on the printed circuit board. A screw 70 is received through the screw hole 58 of the grounding strap 56. The screw 70 is then received through screw receiving hole 43 of the housing 20 and is screwed into screw hole 37 of the conducting shell 33. The screw 70 provides electrical connection between the ground strap 56 and the signal ground on the coaxial connecting portion 22.

When the tap connector 12 is mounted to the transceiver 14, a screw 76 is inserted through holes 80 on walls 44 of the transceiver 14, see FIG. 5. The screw 76 is then received through the PEM nut 72 on the printed circuit board 62. The wall 44 is made of a conductive material and is electrically connected to the chassis ground. The screw 76 provides electrical connection between the chassis ground on the transceiver, the conductive plane 67, and the end of the chip capacitor 68.

The screw 70 provides electrical connection of the signal ground to the grounding strap 56 and then to the one end of the chip capacitor. The other end of the chip capacitor is electrically connected to the chassis ground by way of the conductive ground 67, the PEM nut 72, the screw 76, and the walls 44. The chip capacitor provides a low impedance pathway for electrical static discharges and high frequency noise from the signal ground to the chassis ground. The ESD and the common mode EMI can thereby be shunted from the ground signal without providing a grounding connection to the ground signal.

The tap connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. A tap connector for a coaxial cable to electrically connect signal and signal ground of the coaxial cable to a transceiver, the transceiver being also connected to earth ground, the connector comprising:

a connecting member having a center conductor, an outer conductive shell, a signal tap contact and a ground tap contact, said center conductor being electrically connected to the signal of the coaxial cable and to the signal tap contact to provide signal to the transceiver, said shell being electrically connected to the signal ground of the coaxial cable and to the ground tap contact for providing signal ground to the transceiver; and a shunt subassembly comprising a capacitor, a first end of the capacitor being electrically connected to the shell, a second end of the capacitor being electrically connected to the earth ground on the transceiver;

whereby noise and electrostatic discharge is shunted from signal ground to earth ground by way of said capacitor wherein said shunt subassembly further comprises a circuit board having a conductive plane in a hole extending therethrough, a grounding strap having a screw hole therein, and a capacitor being a chip capacitor which is mounted on to the circuit board so that the second end of the capacitor is electrically connected to the conductive plane, wherein a screw is received in a hole in the transceiver and into the hole on the circuit board, the screw providing electrical connection from the earth ground on the transceiver to the conductive plane and to the second end of the capacitor, wherein the outer shell includes a screw hole, a screw being received through the hole of the grounding strap and into the screw hole of the shell, one end of the grounding strap being soldered to the first end of the capacitor, electrical connection for the signal ground being provided through the screw to the grounding strap and to the first end of the capacitor.

2. The tap connector of claim 1, further comprising a dielectric housing having a top wall and interior chamber, the connecting member being mounted on said top wall and said shunt subassembly being mounted inside said interior chamber.

3. The tap connector of claim 2, wherein said shunt subassembly is mounted in one end of the housing, said signal tap contact and said ground tab contact being disposed in a middle of the connecting member and extending through a middle of the housing.

4. The tap connector of claim 3, wherein a second shunt subassembly is disposed in a second end of the housing.

5. A tap connector for a coaxial cable to capacitively couple signal ground of the coaxial cable to earth ground on a transceiver; the connector comprising:

a connecting member having a center conductor, an outer conductive shell, and a ground tap contact, said shell being electrically connected to the signal ground of the coaxial cable and to the ground tap contact for providing signal ground to the transceiver; and a shunt subassembly comprising a capacitor, a first end of the capacitor being electrically connected to the shell, a second end of the capacitor being electrically connected to the earth ground on the transceiver;

whereby noise and electrostatic discharge is shunted from signal ground to earth ground by way of said capacitor, wherein said shunt subassembly further comprises a circuit board having a conductive plane in the hole extending therethrough a grounding strap having a screw hole therein and the capacitor being a chip capacitor which is mounted onto the circuit board so that the second end of the capacitor is electrically connected to the conductive plane, wherein a screw is received in a hole in the transceiver and into the hole on the circuit board, the screw providing electrical connection from the earth ground on the transceiver to the conductive plane and to the second end of the capacitor, wherein the outer shell includes a screw hole, a screw being received through the hole of the grounding strap and into the screw hole of the shell, one end of the grounding strap being soldered to the first end of the capacitor, electrical connection for the signal ground being provided through the screw to the grounding strap and to the first end of the capacitor.

6. The tap connector of claim 5, further comprising a dielectric housing having a top wall and interior chamber, the connecting member being mounted on said top wall and said shunt subassembly being mounted inside said interior chamber.

7. The tap connector of claim 6, wherein said shunt subassembly is mounted in one end of the housing, said signal tap contact and said ground tab contact being disposed in a middle of the connecting member and extending through a middle of the housing.

8. The tap connector of claim 7, wherein a second shunt subassembly is disposed in a second end of the housing.

* * * * *